US005916829A

United States Patent [19]

Girard et al.

[11] Patent Number: 5,916,829

[45] Date of Patent: Jun. 29, 1999

[54] LAMINATED FABRIC WITH UNIFORM PATTERN OF ADHESIVE SECUREMENT AND GARMENTS MADE THEREFROM

[75] Inventors: Patrick Girard, Lyons; Fred Zeschky, Chatanay, both of France

[73] Assignee: Playtex Apparel, Inc., Stamford, Conn.

[21] Appl. No.: 08/616,080

[22] Filed: Mar. 14, 1996

[30] Foreign Application Priority Data

Mar. 30, 1995 [EP] European Pat. Off. ..... 95302138

[51] Int. Cl.[6] ..... A41C 1/08

[52] U.S. Cl. ..... 442/244; 442/182; 442/183; 442/255; 442/304; 442/306; 450/122; 450/123; 450/124; 450/156; 450/39; 450/40

[58] Field of Search ..... 428/141, 152, 428/163, 183; 442/182, 183, 244, 255, 304, 306; 450/122, 123, 124, 156, 39, 40

[56] References Cited

U.S. PATENT DOCUMENTS

| | | |
|---|---|---|
| 2,915,067 | 12/1959 | Bracht . |
| 3,021,844 | 2/1962 | Flagg et al. . |
| 3,225,768 | 12/1965 | Galitzki et al. . |
| 3,228,401 | 1/1966 | Byrne . |
| 3,317,645 | 5/1967 | Nirenberg . |
| 3,320,346 | 5/1967 | Galitzki et al. . |
| 3,327,707 | 6/1967 | Storti . |
| 3,383,263 | 5/1968 | Storti . |
| 3,489,154 | 1/1970 | Kasper et al. . |
| 3,497,415 | 2/1970 | Adachi . |
| 3,750,673 | 8/1973 | Penrock . |
| 4,135,025 | 1/1979 | Backes . |
| 4,172,002 | 10/1979 | Gluckin . |
| 4,375,445 | 3/1983 | Cole et al. . |
| 4,419,997 | 12/1983 | Cole et al. . |
| 4,720,415 | 1/1988 | Wielen et al. . |
| 4,776,916 | 10/1988 | Prunesti et al. . |
| 5,447,462 | 9/1995 | Smith et al. . |

FOREIGN PATENT DOCUMENTS

| | | |
|---|---|---|
| 0508204A1 | 10/1992 | European Pat. Off. . |
| 1136371 | 12/1968 | United Kingdom . |

*Primary Examiner*—Richard Weisberger
*Attorney, Agent, or Firm*—Abelman, Frayne & Schwab

[57] ABSTRACT

A fabric laminate (10) comprises first and second stretch fabrics (11 and 12) having an intermediate adhesive securement layer (13) between them. The adhesive securement layer (13) is in the form of a regularly repeated pattern which comprises an array of aligned adhesive elements (14) arranged in successive generally horizontally and vertically extending rows. The array of adhesive elements (14) is capable of offering resistance to elongation as the laminate (10) is subjected to distortion, with the pattern having a differential elongation characterized as offering different magnitudes of resistance to elongation when the fabric laminate (10) is subjected to distortion in selected different directions. The adhesive securement layer (13) is predeterminedly oriented in accordance with its differential elongation and the stretch characteristics of fabrics (11,12) such that the resistance to elongation offered by the laminate (10) is determined by the pattern and orientation of the individual adhesive elements (14) in conjunction with the stretch characteristics of the fabrics (11,12). The laminate (10) may be employed to reinforce items of clothing, particularly underwear and the like.

23 Claims, 13 Drawing Sheets

FIG. 1
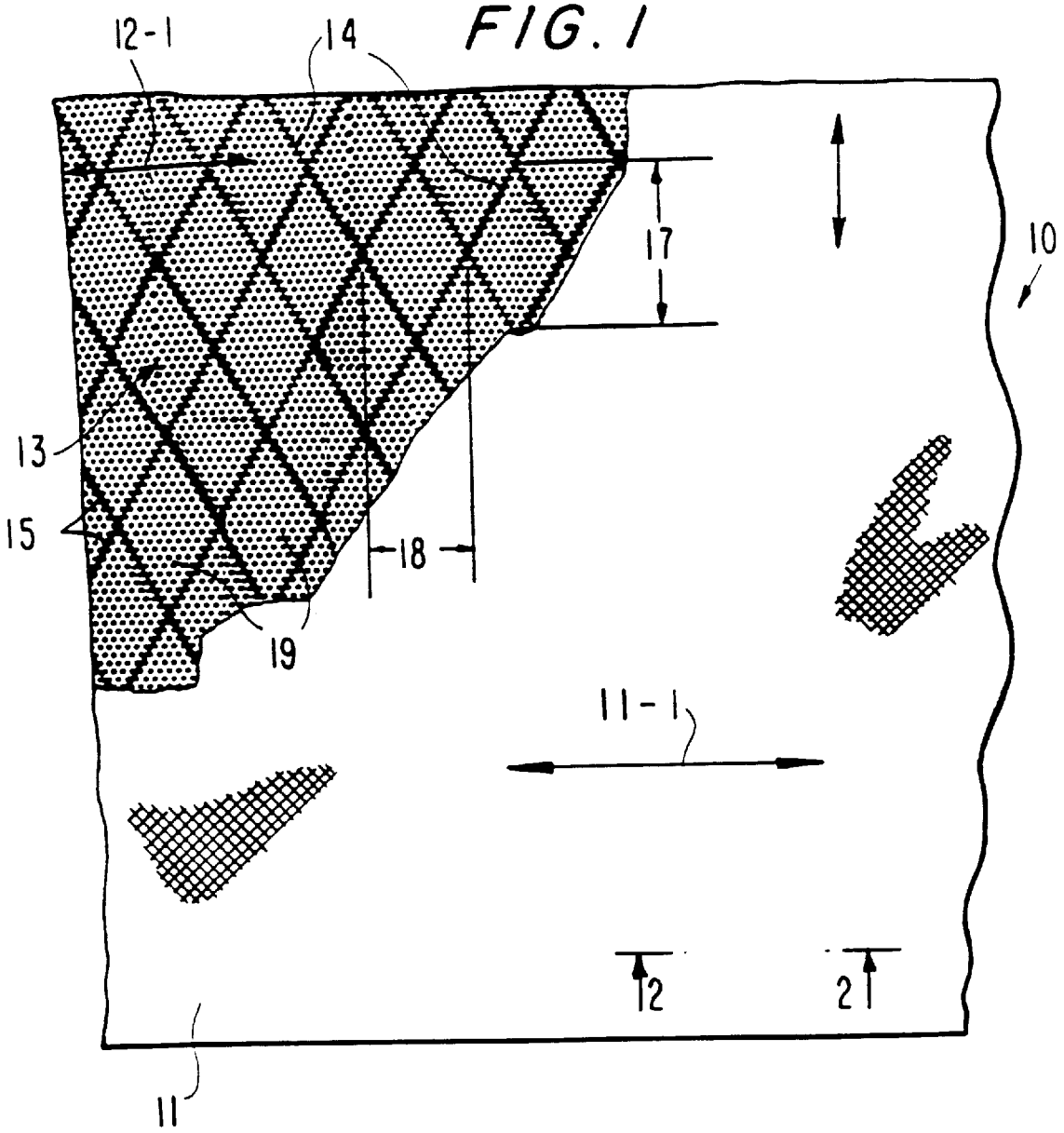
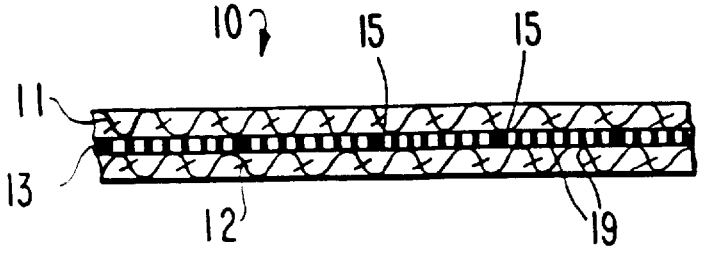
FIG. 2

LAMINATED FABRIC WITH UNIFORM PATTERN OF ADHESIVE SECUREMENT AND GARMENTS MADE THEREFROM

DESCRIPTION

The present invention relates generally to a stretch fabric laminate having particular utility for providing additional reinforcement at desired areas of women's undergarments, such as panties, brassieres, and pantyhose. In such garments it is oftentimes desirable to provide additional support resulting in a desired degree of body constriction for enhanced figure shaping. Such support may be provided by reinforcement panels for restricting the ability of the garment to stretch. Such panels may typically be at the stomach, derriere or thigh regions of a panty or pantyhose, as well as the undercup and/or side panels of a brassiere. Such support has in the past been provided by additional panels which are sewn to the main body fabric of the garment. Such sewing disadvantageously adds to the costs, stiffness and overall bulk of the product, oftentimes presenting to the consumer a garment having undesirable heaviness.

An improved arrangement for providing such additional support is the subject of applicant's European patent specification 0255101B1 published Nov. 18, 1993 in the name of Prunesti, et al. and entitled "Method and Apparatus For Providing Additional Support To Selected Portions of A Garment And Garment Produced Thereby", in which the additional support panel is adhesively secured to the main body panel. The adhesive securement is obtained by applying a desired pattern of a hot melt adhesive powder to the fabric of the support panel through a silk screen. The support panel is then heat cured and cut to its desired shape. The panel is then laminated to the main body fabric, with the powder adhesive being fused to and substantially confined between the two fabric layers so as to interconnect the fabric layers. The additional support provided by the reinforcement panel is predeterminately controlled by the selected shape and configuration of the pattern and thickness of the adhesive layer in conjunction with the stretch characteristics of the fabrics.

Another advantage of this structure is that fabrics can be selected such that the pattern of the adhesive layer is visible through at least one of the fabrics (e.g. the reinforcement panel). Accordingly, the pattern of the adhesive layer, in addition to contributing to the requisite additional support, can be selected to provide a pleasing aesthetic presentation, which is imparted and delineated to the outer layer of one of the fabrics (without adhesive being present on the outer fabric layer) so as to provide further consumer enhancement of the product.

The product produced by the European Patent Specification 0255101B1 process has achieved substantial consumer acceptance and utility. However, the utilization of the silk screen for applying the powdered adhesive pattern limits the manufacturing speed and overall efficiencies in the fabrication of the laminate and the resultant undergarments. Further, it has been experienced that the uniformity of the pattern applied through the silk screen is subject to variation, dependent upon such factors as humidity and the practical difficulty in repeatedly applying uniform pressure over the full extent of the silk screen. A further disadvantageous aspect of this prior process is the requirement that the pattern of the powdered adhesive, which is in the shape of the individual reinforcement panels, be applied to the reinforcement fabric at spaced, discrete areas of the fabric. Accordingly, portions of the fabric between each of the discrete applications of the adhesive pattern must be trimmed away and discarded. Hence, the fabric yield is reduced by such wastage, adding to the manufacturing cost. A further undesirable manufacturing aspect of this process is the requirement that the expanse of the fabric containing the spaced reinforcement must be accurately cut about the perimeter of each reinforcement panel. This naturally tends to slow the manufacturing process, again adding to the product's cost.

Several of the production problems and costs associated with the silk screen application of powdered adhesive at discrete and separated portions of the support fabric may be alleviated according to applicant's PCT Publication WO 94/23601 of Oct. 27, 1994, in the name of Smith et al, and entitled "Fabric Laminate And Garments Incorporating Same". As disclosed therein, the support panel is adhesively secured to the body by the unique application of an integral adhesive web. The web, while not having a definitive pattern, is characterized as offering different magnitudes of resistance to elongation when subjected to distortion in its different directions. The adhesive web is predeterminately oriented within the laminate in accordance with its differential elongation characteristics such that the additional support provided by the support panel and the adhesive web is combinedly determined by the differential stretch characteristics of the adhesive web, the stretch characteristics of the fabrics, and their relative orientation. The adhesive web is in the form of a net-like film which may be readily cut to conform to the shape of the reinforcement panel, keeping in mind only its differential elongation characteristics so as to maintain the desired orientation with respect to the fabric layers. Inasmuch as the reinforcement layers are separately cut from their fabric yard goods, this process does not require the separation of discrete panels on the reinforcement fabric, prior to cutting into individual panels, nor the high degree of accuracy previously demanded in cutting out the individual panels of European Patent Specification 025501B1 which had been silk screened on the support fabric. While increasing the manufacturing efficiency, a disadvantage of this process is that the adhesive web, while exhibiting differential stretch characteristics, does not have the ability to provide a more substantial variation in support otherwise achieved by the design of the specific pattern of the silk screen adhesive applique. That is, where the pattern had been applied through the silk screen, the design of the pattern may be changed to adjust the degree of control which is to be contributed by the adhesive layer. For example, where a higher degree of control is required, the pattern would be modified to provide a greater concentration of adhesive while still maintaining the requisite soft feel or "hand" of the fabric. Likewise different product applications of the support panel (as between a panty, pantyhose, or a brassiere) would typically require different degrees of support. This can be achieved by the selection of the reinforcement fabric in conjunction with varying the pattern selected for the adhesive layer. Further, the adhesive web of this process does not present a pattern visible at the outer surface of at least one of the laminate fabrics.

The fabric laminate in accordance with the present invention advantageously permits the higher manufacturing speeds and efficiencies of a continuous process, devoid of discrete-spaced applications of separate adhesive panels on the support panel fabric, while achieving the several advantages of applying the adhesive to the support panel in the form of a desired pattern. More specifically, in contrast to the net-like film of adhesive utilized in applicant's aforementioned PCT Publication WO 94,23601, the present invention applies the adhesive securement layer in the form of a regularly repeating pattern, generally coextensive with and uniformly presented over the full extent of the support fabric. The pattern comprises an array of aligned individual adhesive elements, such as diamonds, which are arranged in successive generally horizontally and vertically extending rows. The individual elements are so configured and located such that they are capable of offering resistance to elongation as the laminate formed with the support fabric is subjected to distortion. The pattern is designed to have differential elongation, characterized as offering different magnitudes of resistance to elongation when the fabric laminate is subjected to distortion in selected different directions. Hence, with the adhesive securement layer being predeterminately oriented in accordance with its differential elongation and the stretch characteristics of the fabrics, the resistance to elongation offered by the fabric laminate will be determined by the pattern and orientation of the individual adhesive elements in conjunction with the stretch characteristics of the fabrics. The adhesive is preferably a thermoplastic such that when the support panel is applied to the body fabric of the garment, the adhesive will, upon suitable temperature, be reactivated to securably adhere the support panel to the body fabric, forming the laminate of the present invention. The adhesive will be confined to between the fabric layers so as to neither a) adversely affect the hand of the laminate, nor b) lock itself around the yarn forming the fabric.

Typically where the subject invention is used in conjunction with a woman's panty or pantyhose the support panel will be at least adhesively secured to the stomach region of the garment. At that location it will be oriented to provide a greater resistance to stretch in the horizontal than in the vertical direction, thereby serving to restrict the outward projection of the wearer's stomach, to provide a more slender profile to enhance the figure control properties of the garment. Such additional control can also be provided at the thigh and/or derriere region. When used in conjunction with other garments it will be located and properly oriented where additional control is desired (e.g. to restrict horizontal stretch at the undercup region of a brassiere).

Advantageously, the degree of additional reinforcement, and hence figure control, provided by the securement layer can be suitably adjusted by making variations in the pattern and size of the individual adhesive elements, the placement and pattern of supplemental adhesive elements (e.g. dots) within each of the individual adhesive elements, the width of the sides forming the individual adhesive elements, the thickness of the adhesive securement layer as well as the characteristics of the particular adhesive. Further, as contrasted to the interrupted application of powdered adhesive through a silk screen, the adhesive securement layer of the present invention is advantageously continuously applied as a uniform layer of liquid adhesive from the outer patterned surface of a rotating cylinder. The cylinder may be hollow with a patterned circumferential screen about its outer perimeter. The liquid adhesive is introduced into the interior of the cylinder and uniformly forced outward against the fabric by an internally supported doctor blade. Alternatively, the pattern may be engraved about the outer cylindrical surface, with the depth of engraving corresponding to the desired thickness of the adhesive layer. The liquid adhesive will then be applied to the outer surface of the cylinder and transferred to the fabric by known techniques, such as a doctor blade at the terminus of the adhesive containing trough.

The reinforcement fabric layer with the adhesive pattern uniformly applied thereto over substantially its entire surface will then be typically passed through an oven for drying the adhesive. This fabric layer may then be laminated to a continuous expanse of the main body fabric of the garment, which is then cut into apparel panels (such as 21 of FIG. 5). Alternatively, individual reinforcement panels can be cut from the expanse of the reinforcement fabric for subsequent lamination to a portion of a garment panel (such as 59 of FIG. 13). In either situation, the desired configuration of the support panels is cut out from this fabric containing the adhesive pattern. Because of the regularly repeated nature of the adhesive pattern, there will be a minimum of fabric loss, and a substantially greater amount of tolerance permitted in cutting out the individual support panels, than if they were applied to the reinforcement fabric at discrete separated areas thereof. That is, in forming the reinforcement panels from the expanse of the support fabric cognizance must only be maintained of the differential elongation characteristics of the adhesive layer, so as to insure that when the reinforcement panel is laminated to the garment, its pattern will be properly oriented to provide the requisite support.

The prior art, in addition to applicant's aforementioned EPO Publication 0255101-B1 and PCT Publication WO 94/23601 have suggested the utilization of an intermediate adhesive layer for securing a reinforcement panel to an undergarment. However, such prior constructions have failed to achieved the numerous advantages of the instant invention, including maintaining a desired soft hand for the laminate, allowing substantial versatility in adjusting the degree of control provided by the adhesive layer in conjunction with the garment fabrics, and manufacturing efficiencies attendant to the present invention. For example, in Byrne U.S. Pat. No. 3,228,401 plastic reinforcing material is applied to the fabric as a flowable paste which is intended to flow into the fabric and embed the individual threads forming the fabric. The plastic reinforcement may be patterned to provide reinforcement in one direction and not in the other. However, the flowing of the plastic into the fabric results in an undesired stiffening of the fabric, changing its hand or feel, and may result in irritation when applied to the skin of the wearer. Galitzki et al. U.S. Pat. Nos. 3,225,768 and 3,320,346 similarly show a cloth and plastic laminate for a breast support such as a bathing suit, in which the elastomeric polyethylene polymer bonds two fabrics together with the plastic flowing within the interstices of the fabric; Likewise, Storti U.S. Pat. No. 3,327,707 uses an elastomeric adhesive to secure a stomach control panel to a foundation garment with the adhesive flowing into the girdle fabric to lock itself around the individual stretch yarns.

The utilization of stiffening panels or other elements within undergarments or other apparel products is also generally shown in Flagg et al. U.S. Pat. No. 3,021,844 which shows a brassiere reinforced in the breast cup area by a stiffening liner; Penrock U.S. Pat. No. 3,750,673 which is similarly directed to a brassiere have a plurality of plastic stays positioned below the cup portion; Bracht, U.S. Pat. No. 2,915,067 wherein stiffening elements are adhesively secured to the lower cup portion of a brassiere, or waist band of a girdle; Glucken U.S. Pat. No. 4,172,002 which laminates a patch of moldable fabric as a brassiere undercup support element. Robinson U.S. Pat. No. 4,372,321 provides a brassiere which has a unitary molded breast cup including an intermediate lower cup support panel adhesively bonded to the cup by a polyester hot melt adhesive which may typically be applied through a screen which allows dotted coverage of the surface. Such an adhesive pattern does not have differential elongation characteristics. As contrasted to the present invention, there is no teaching that the pattern and orientation of the adhesive can be designed to be a factor in controlling the overall laminate elongation characteristics. Nirenberg U.S. Pat. No. 3,317,645 discloses another method for forming a laminate or molded article such as brassiere cups with an intermediate plastic layer. Cole et al U.S. Pat. Nos. 4,375,445 and 4,419,997, both assigned to the assignee of the present invention, are directed to a molded cup brassiere in which the cup is formed of a laminate consisting of two layers of stretchable material which include a non-stretchable crown portion, a substantially non-stretchable longitudinal cup portion and a unitary multi-dimensional stretchable periphery portion.

Storti U.S. Pat. No. 3,383,263 is directed to a method for preparing a fabric laminate by laminating two fabrics by means of regularly recurring spaced geometric units of substantially dry adhesive film sandwiched between the outer fabric surfaces, with the result laminate having a raised pattern portion as determined by the adhesive pattern.

Adachi U.S. Pat. No. 3,497,415 forms a laminate including fabrics of different elasticity secured together with a conventional adhesive, such that the laminate characteristics are primarily determined by the elasticity of the two fabric layers. Backes U.S. Pat. No. 4,135,025 varies the stretch characteristics of a fabric by the selective insertion of different warp and weft threads into the fabric.

Additional composite elastomeric materials are disclosed in Kasper et al. U.S. Pat. No. 3,489,154 issued to the assignee of the instant application and Vander Wielen U.S. Pat. No. 4,720,415.

According to the present invention there is provided a unique fabric laminate.

Accordingly it is still a further aspect of the invention to provide a reinforcement panel formed of a unique fabric laminate for use in an article of apparel.

To this end a garment reinforcement panel is formed of a stretch fabric layer onto which is applied an adhesive securement layer in the form of a regularly repeated pattern generally coextensive therewith and uniformly presented over substantially its full extent. The adhesive pattern comprises an array of aligned individual adhesive elements arranged in successive generally horizontally and vertically extending rows. The adhesive elements are configured such that they offer resistance to elongation as the laminate is subjected to distortion, with their pattern demonstrating a differential elongation, characterized as offering different magnitudes of resistance to elongation when subjected to distortion in selected different directions. This support panel is laminated to the fabric forming the garment where additional support is desired (e.g. the stomach area), and oriented such that the differential elongation characteristic of the adhesive securement layer contributes to achieving the desired additional support. Various garments are disclosed which include the support panel for providing the requisite additional support. Further, by varying the pattern of the adhesive securement layer, as well as the individual elements comprised therein, the degree of additional support or body control contributed by the adhesive layer can be suitably adjusted.

The invention will now be described with reference to the accompanying drawings in which:

FIG. 1 is an elevation view of the layers forming the laminate in accordance with the present invention, with the body fabric being partially broken away to reveal the underlying support panel and adhesive securement layer.

FIG. 2 is a cross-sectional view of the laminate form of the layers shown in FIG. 1 along the arrows 2—2.

Figure 3:
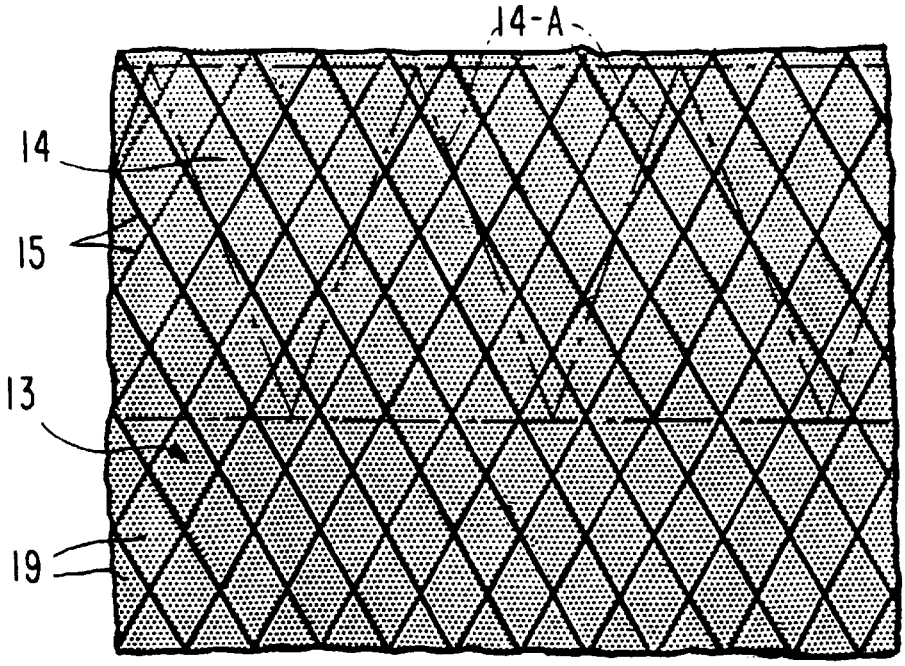
FIG. 3 is an elevation view of the reinforcement panel having the adhesive securement layer applied thereto, shown reduced and indicating the manner in which the individual support panels may be cut out from the expanse of the fabric.
Figure 4:
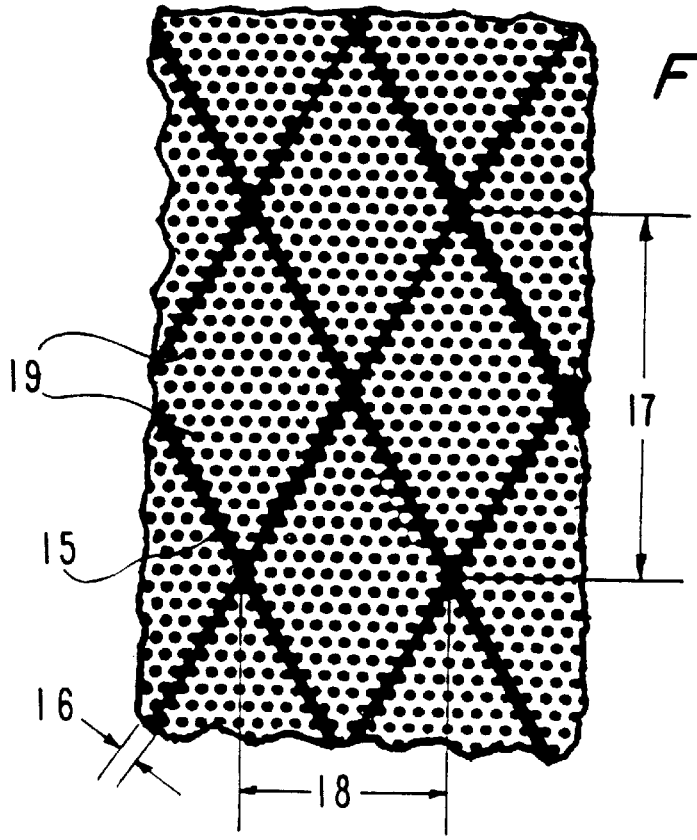

FIG. 4. is an enlargement of a portion of FIG. 3., showing the particular pattern of the adhesive layer in greater detail.

Figure 5:
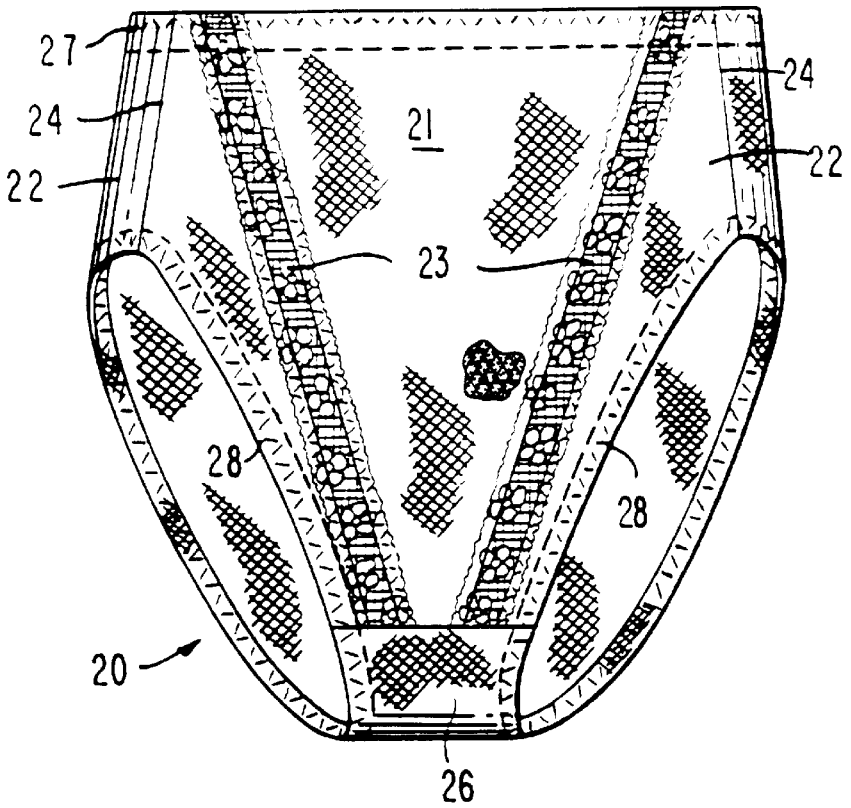

FIG. 5. is a front view of a panty in which the laminate of the present invention forms a stomach panel.

Figure 6:
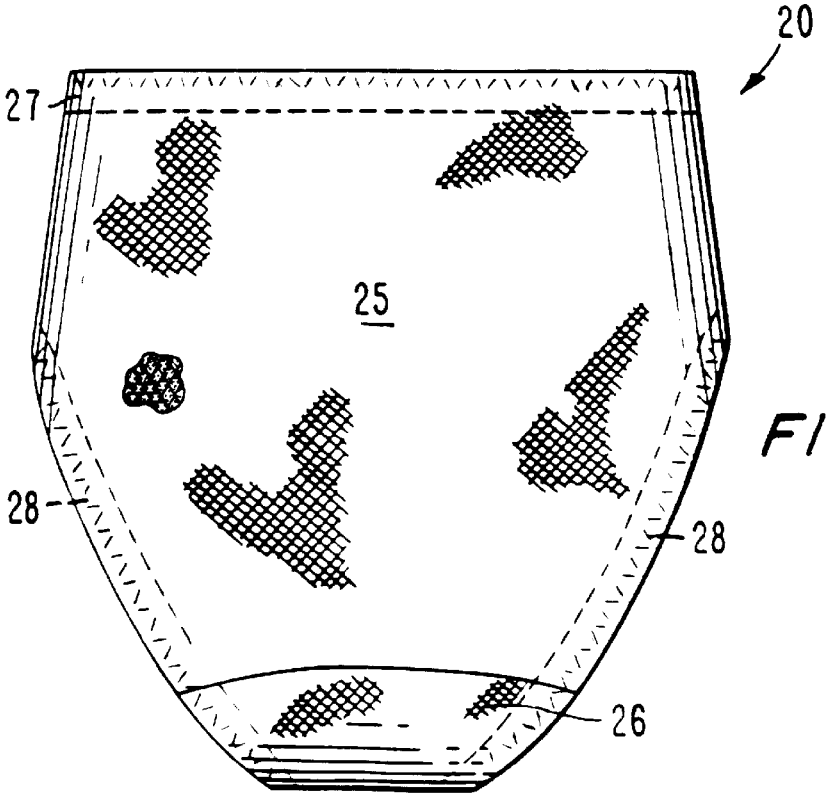

FIG. 6. is a rear view of the panty shown in FIG. 5.

Figure 7:
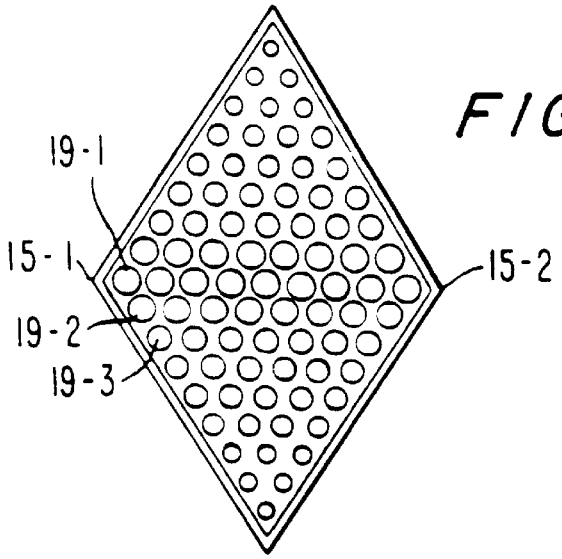

FIG. 7. is a view corresponding to FIG. 4, but showing a variation in the pattern of the adhesive securement layer.

FIGS. 8–12. depict further variations in the pattern of the adhesive securement layer.

Figure 13:
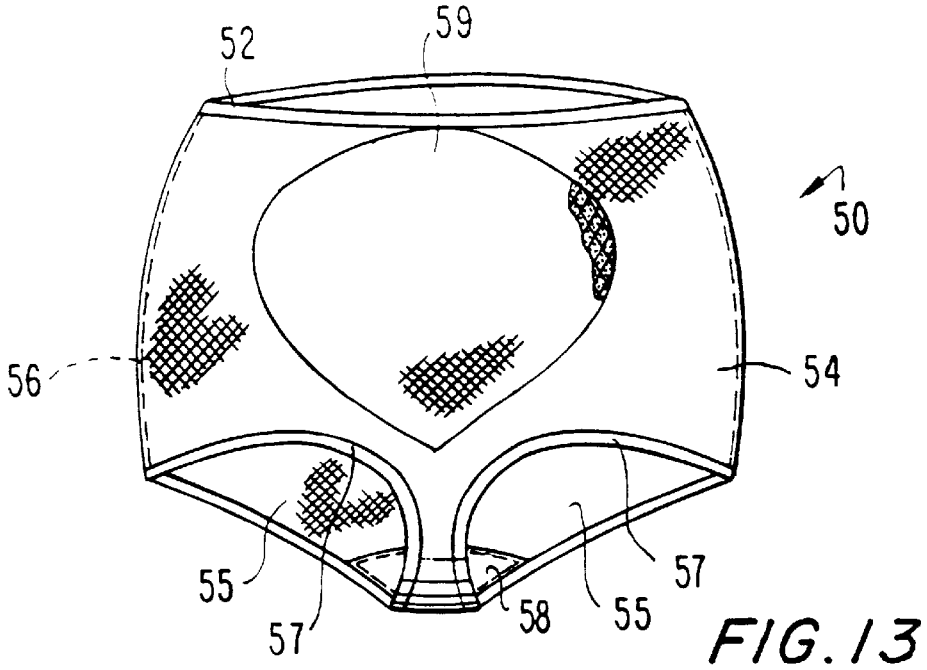

FIG. 13. is a front view of an alternative panty construction in which the support panel of the present invention is shaped to conform to a stomach panel, and laminated to a larger fabric piece forming the front portion of the panty.

Figure 14:
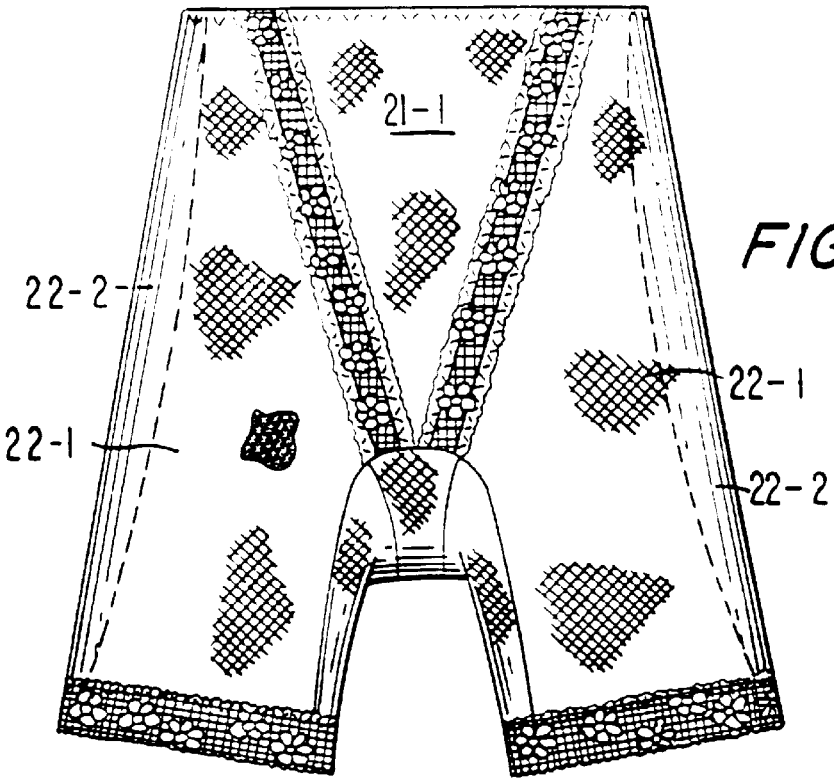

FIG. 14. is a front view of a panty similar to that shown in FIG. 5, but including a longer leg portion.

Figure 15:
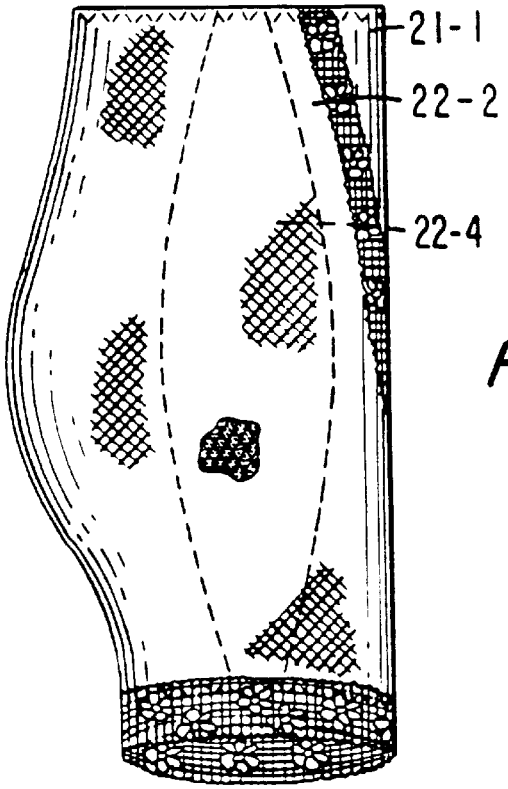

FIG. 15. is a side view of the long leg panty shown in FIG. 14, and includes a thigh control panel which is laminated to the main body panel in accordance with the present invention.

Figure 16:
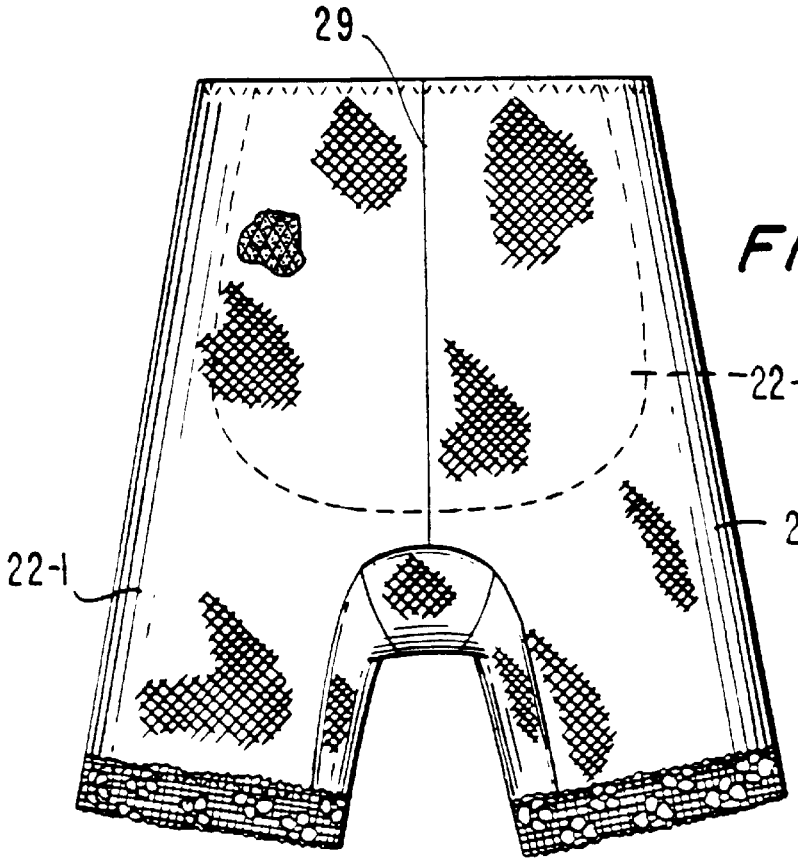

FIG. 16. is a rear view of the panty shown in FIGS. 14 and 15, which also includes a rear control panel in accordance with the present invention.

Figure 17:
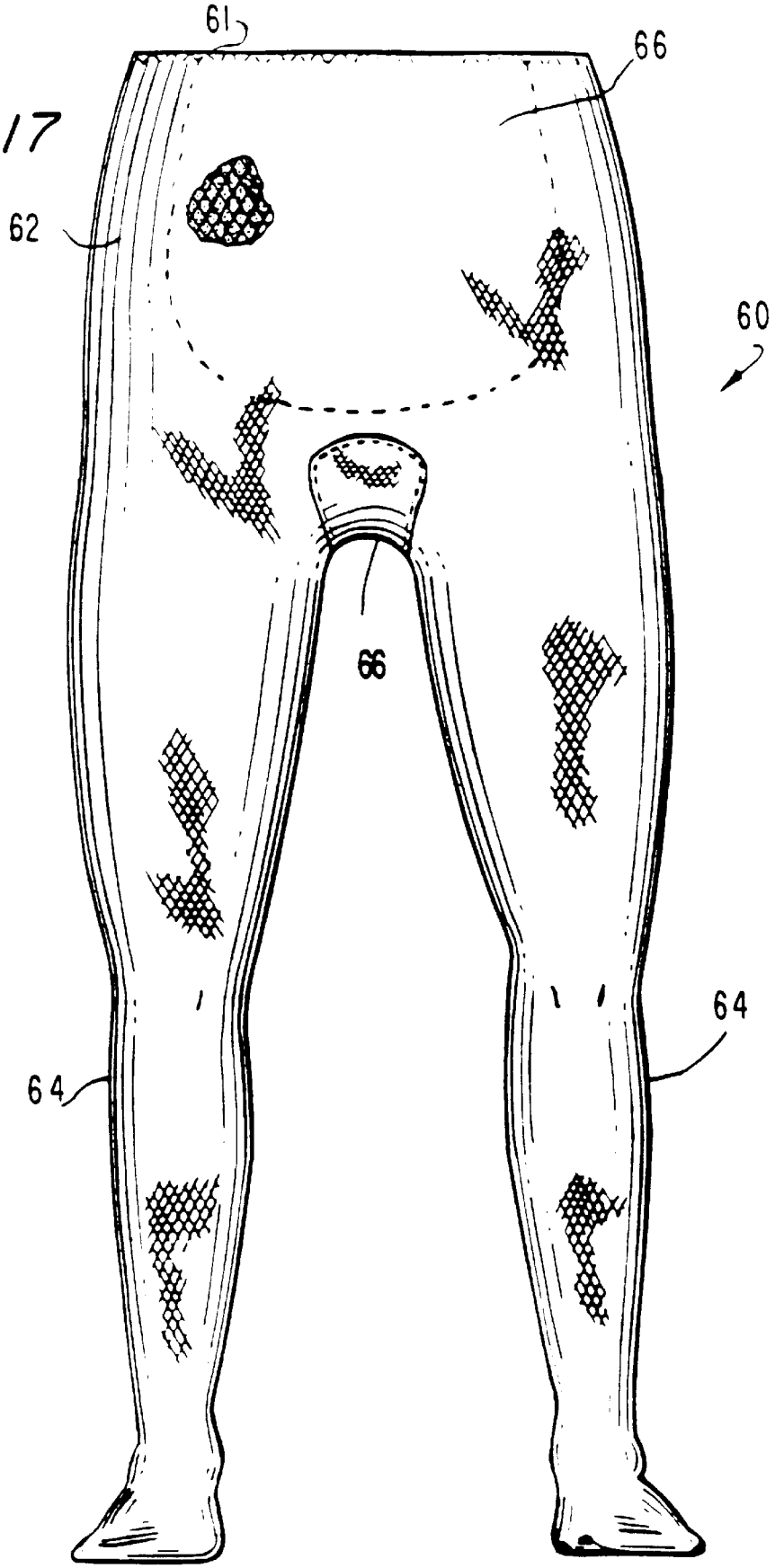

FIG. 17 is a front view of a pair of pantyhose which includes a stomach panel in accordance with the present invention.

Figure 18:
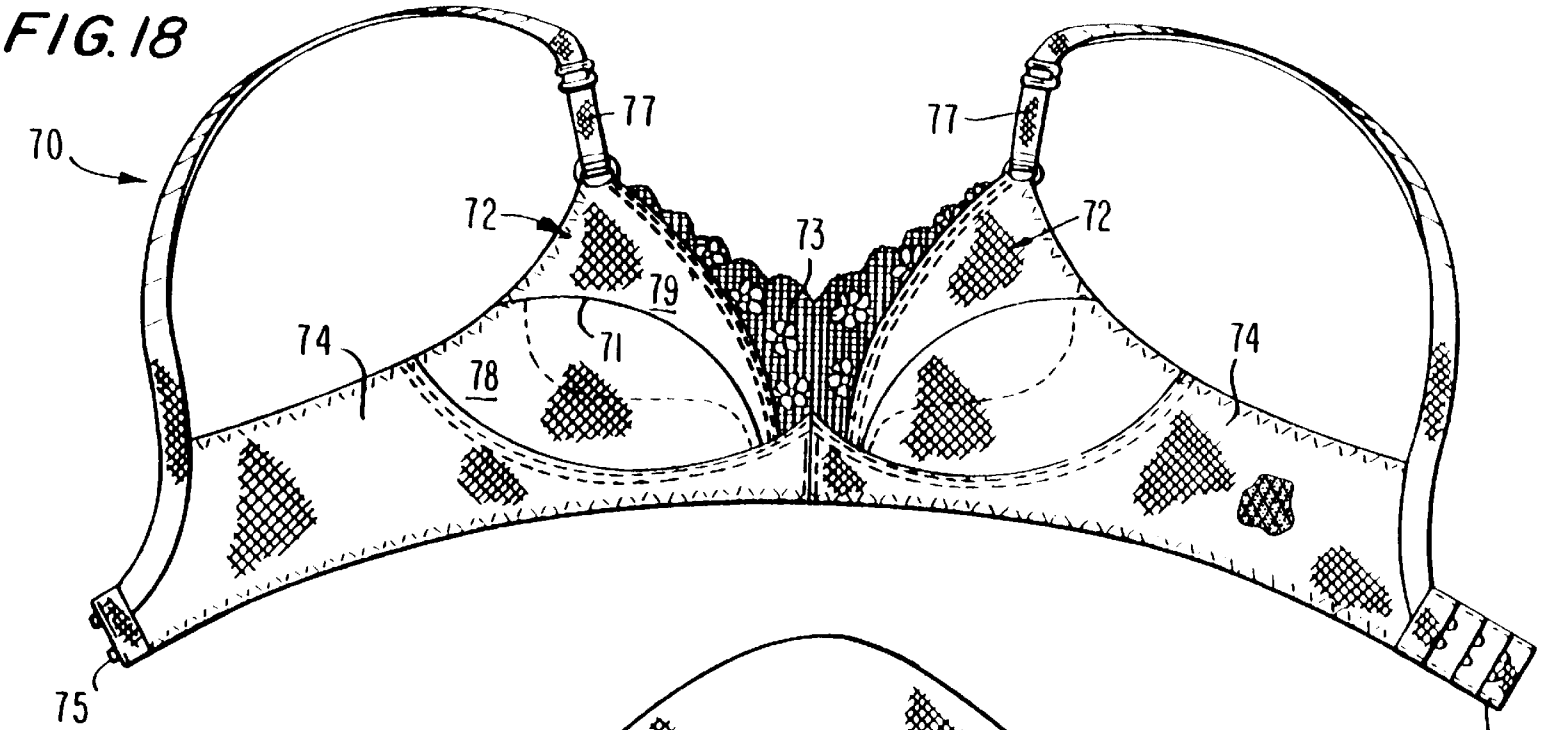

FIG. 18. is a front view of a brassiere which includes an undercup support panel in accordance with the present invention.

Figure 19:
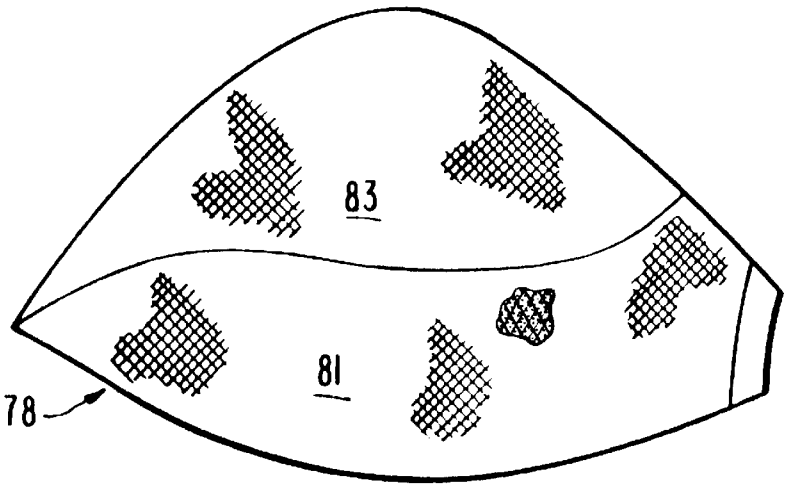

FIG. 19. is an elevation view of the lower cup section of the brassiere shown in FIG. 18

Figures 20, 21:
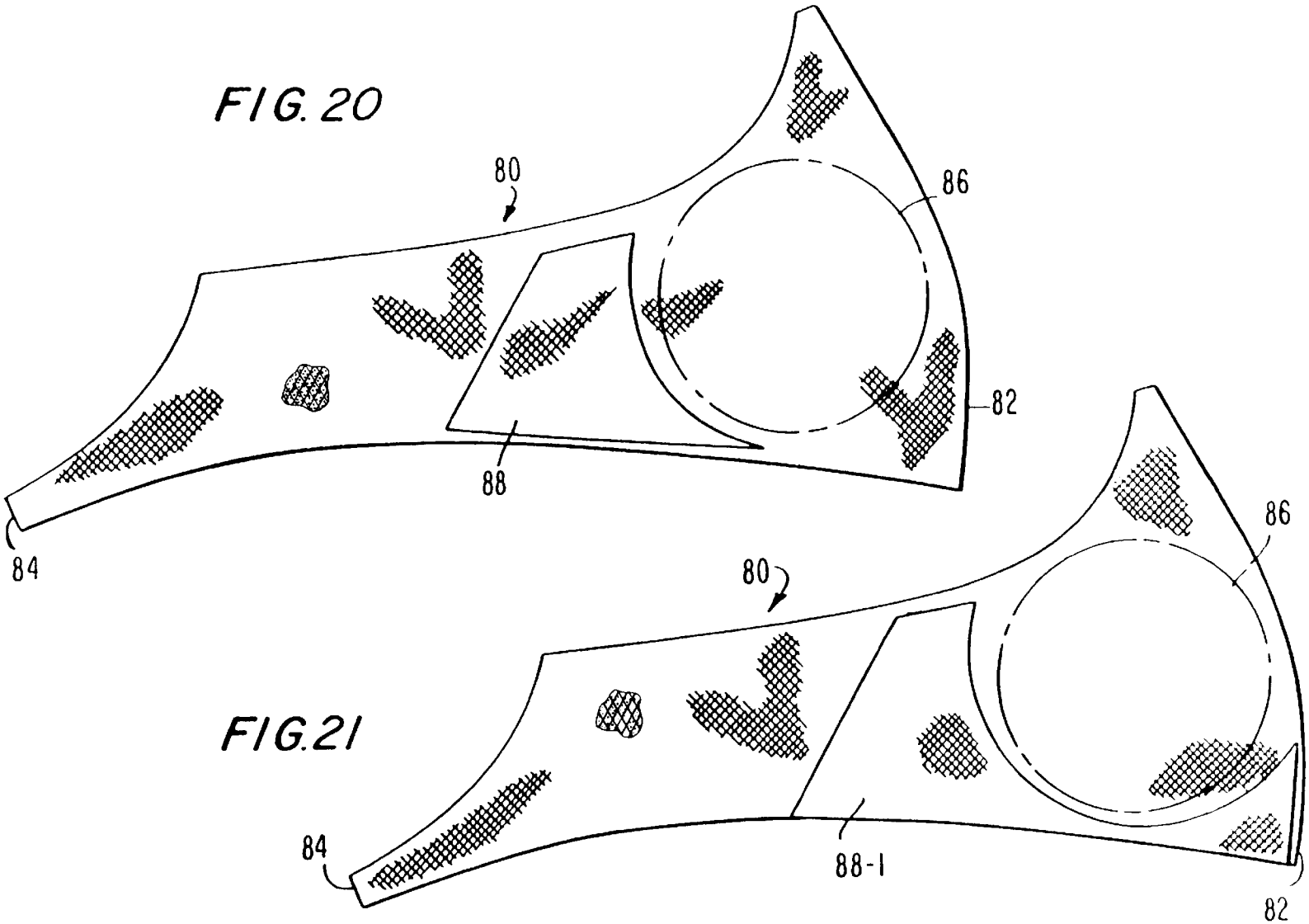

FIGS. 20 and 21. show alternative placements of the laminate support panel of the present invention within a brassiere.

Figure 22:
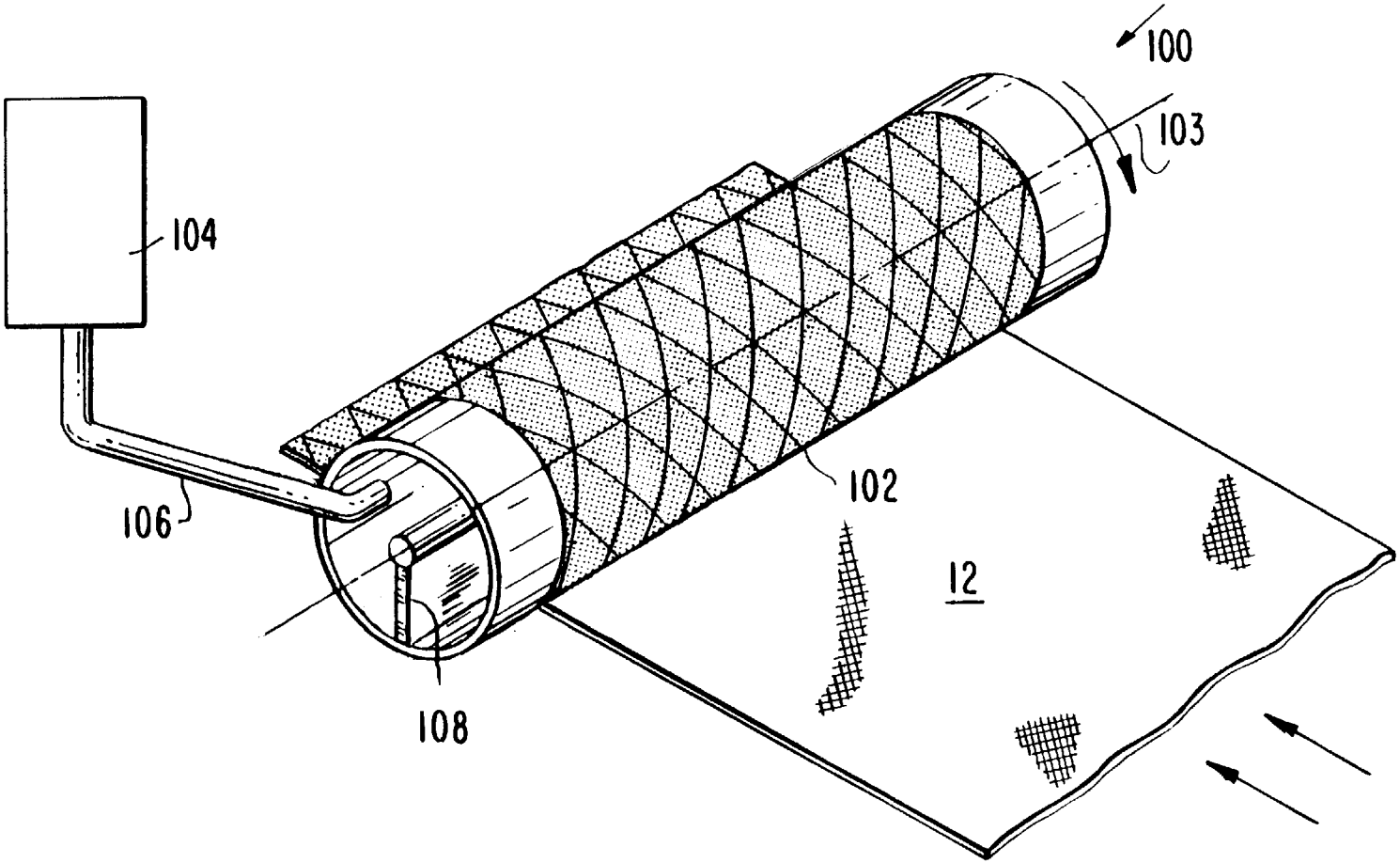

FIG. 22. generally shows an apparatus and method for applying the adhesive securement layer to one of the fabrics forming the laminate.

Referring initially to FIGS. 1–4, FIG. 1 depicts a portion of the fabric laminate 10, in accordance with the present invention which will be located at the region of a garment requiring additional support. The fabric laminate includes the main, or body, fabric layer 11 of the garment. Fabric layer 11 is typically an elastomeric fabric including Lycra yarn to provide a desired degree of resistance to stretch. Hence, the magnitude of its resistance to elongation, which can be controlled by the elastomeric yarn, is referred to as the modulus of the fabric. If the laminate 10 forms a portion of the stomach panel of a panty, fabric layer 11 will have its primary elongation and modulus in the generally horizontal direction, as shown by the arrows 11-1.

The reinforcement panel is provided by a stretch fabric 12 upon which the adhesive securement layer 13 of the present invention has been previously applied over its entire surface. Reinforcement layer 12 may also be an elastomeric fabric. For cost saving, fabric 12 may preferably be a non-elastomeric stretch fabric, wherein the stretch is achieved by the construction of the fabric as by a circular knit. Fabric 12 will also have a primary direction of stretch. Alternatively, fabric 12 could be woven with its yarn placed at an angle (e.g. 45°) with respect to the anticipated distorting force. This is be referred to as bias stretch which occurs from the ability of the fabric construction to distort and permit elongation without the use of elastomeric yarn. As is typical of stretch fabric 12, whether or not it includes elastomeric yarn, it will have primary elongation in one direction as shown by the arrows 12-1 of FIG. 1, with there being a lesser degree of elongation, or give, in the direction orthognal to that shown by those arrows. Advantageously, fabric 12 is sufficiently sheer that the pattern of the adhesive layer will be visible at its outer surface, thereby providing a pleasing aesthetic affect and informing the user of its presence.

The adhesive layer applied to the fabric of reinforcement panel 12 is, as shown in greater detail in FIGS. 3 and 4, is in the form of a regularly repeated pattern generally coextensive with and uniformly presented over substantially the full extent of the fabric. The individual panels to be cut from the fabric are shown by the dash lines 14-A in FIG. 3. In the particular embodiment shown in FIGS. 1–4, the pattern comprises an array of aligned diamond shaped elements, indicated as 14 which are arranged in successive generally horizontally and vertically extending rows. The diamond shaped elements 14 are of uniform size throughout the extent of the pattern. The width of the sides 15 forming the diamond is shown as 16 in FIG. 3, and is likewise uniform throughout the extent of the pattern. Each of the diamonds has a vertical length 17 and a lesser horizontal length 18. By virtue of the diamond pattern being oriented within the laminate such that the longer dimension 17 of the diamond is in the generally vertical direction the resistance to elongation offered by the diamond pattern of the adhesive securement layer will have a differential characteristic, exhibiting greater resistance to elongation in the horizontal direction than in the vertical direction.

The pattern of the adhesive securement layer also includes an array of closely-spaced discrete dots 19 of adhesive within each of the diamonds 14. These adhesive dots 19 provide enhanced securement of reinforcement layer 12 to the fabric 11. In particular, the inclusion of such a closely-spaced array of adhesive elements 19 within the larger diamonds 14 precludes the laminate from forming bubbles as it is stretched and released. This serves to maintain a smooth transition from the laminate's relaxed condition to its tensioned state without any unsightly bubble-type discontinuities in the smooth presentation of the laminated reinforcement panel.

Accordingly, when the laminated fabric panel of FIG. 1 is subjected to distorting forces it will offer greater resistance to stretch in the horizontal direction than in the vertical direction, with the modulus, the forces urging the panel towards its relaxed position, being obtained from the body fabric layer 11 and pattern of the adhesive securement layer 14. If desired, a further reduction in laminate elongation characteristics can be achieved if layer 12, which forms the control panel, is oriented 90° with respect to that shown in FIG. 1.

FIGS. 5 and 6 show the front and rear views of a typical women's panty utilizing the laminate of the instant invention for stomach control. The panty is formed of a main body fabric panel which encircles the wearer's torso. This main body panel typically includes several fabric pieces, which are sewn together. Panty 20 includes a front panel 21, frontal side panels 22 and transitional lace panels 23. Side seams 24 connect panels 23 to a rear panel 25. A crotch section 26 is typically provided at the lowermost portion of the garment. An elastic waist band 27 extends along the top of the garment. Another elastic band 28 is sewn around the edges of panels 22 to provide the frontal portion of the leg cut-out, which is continued along the sides of the crotch piece 26 and lower edge of the rear panel 25. In the particular panty shown in FIGS. 5 and 6, fabric panels 22 and 25 are a single layer preferably formed of an elastomeric fabric which, as heretofore discussed, may include Lycra yarn. The front panel 21 is formed of the laminate shown in FIG. 1. Its outer layer corresponds to layer 11 of the laminate, and will typically be of the same fabric as panels 22 and 25, for appropriate aesthetic coordination. The laminate 21 has significantly less horizontal elongation than the panels 22 and 25. That is, the placement of the laminate at the stomach panel provides the well-known type of stomach control to flatten the wearer's stomach and hence provide figure enhancement.

The particular fabric selected for the inner fabric to form the stomach control panel 21 (corresponding to fabric 12 shown in FIGS. 1 and 2) is determined by the desired degree of control. In the panty shown in FIG. 5 the primary elongation directions of the layers forming the stomach panel 21 may typically be horizontal as shown by the arrows of FIG. 1. The main body panels 22, 25 and outer panel of laminate 21 would usually have this primary elongation direction in the horizontal direction. Should a greater degree of stomach control be desired, the innermost layer forming the control panel 21 can be turned 90° so that its primary elongation will be in the vertical direction.

FIGS. 7–12 show various modifications that can be made to the pattern of the adhesive to appropriately adjust the resistance of the laminate to elongation, and hence the degree of control provided by the reinforcement panel. In FIG. 7 the generally uniform size and density of the dots 19 (as for example as shown in FIG. 4) has been modified in that larger dots 19-1 extend across the horizontally displaced corners 15-1, 15-2 of each of the diamond shaped adhesive elements. As shown in FIG. 7 there is a gradual reduction in the size of the adhesive dots and increase in the spacing between their horizontally adjacent rows as shown by dots 19-2, 19-3, etc. displaced from the mid-section of the diamond. Alternatively, except for the enlarged dots of adhesive 19-1 across the horizontally opposed corners 15-1 and 15-2 of the diamond, all of the other adhesive dots within the diamond, while smaller than the dots 19-1, can be of uniform size. The increased amount of adhesive provided by enlarged adhesive dots 19-1 will further increase the resistance of the adhesive pattern shown in FIG. 7 to horizontal elongation, thereby providing somewhat greater horizontal control. Such a pattern could be used where it is desired to provide increased control at the reinforcement panel while still utilizing the same fabrics for the garment, size of reinforcement panel and adhesive thickness.

Figure 8:
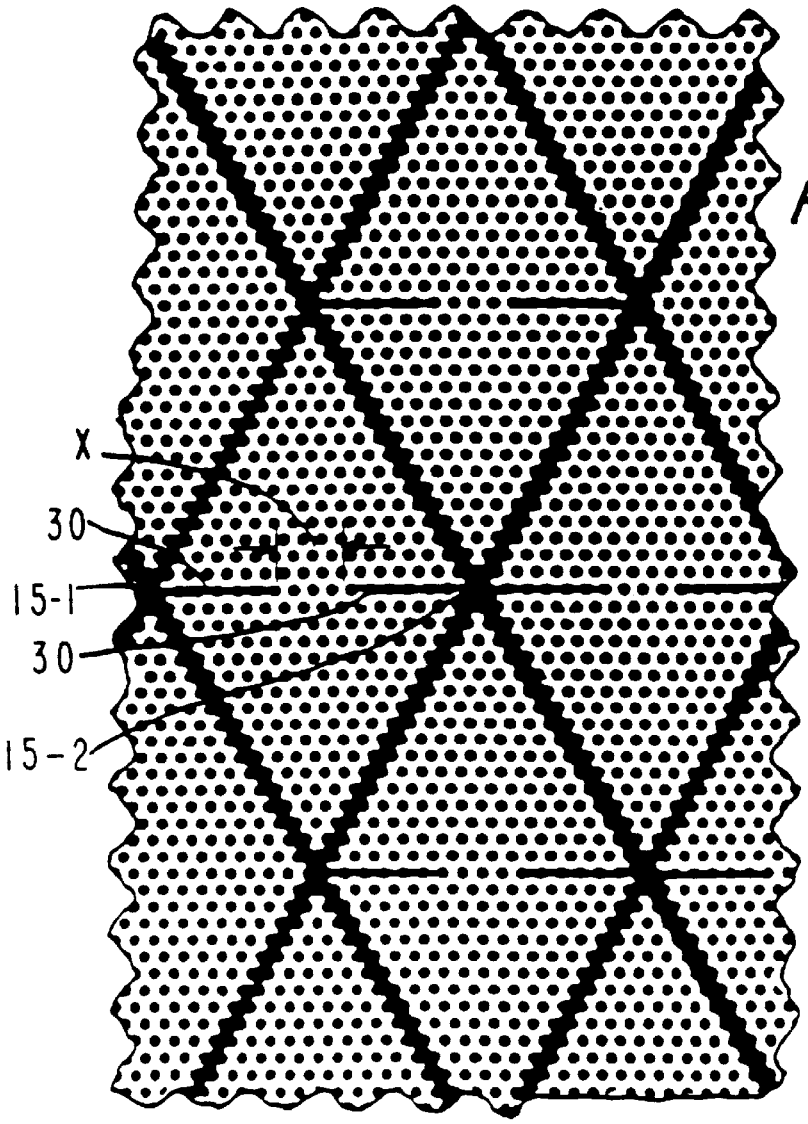

FIG. 8 shows another variation in which horizontally extending lines of adhesive 30 extend from the opposed horizontal corners 15-1 and 15-2 of the diamond, towards the center of the diamond. Advantageously a gap X is provided at the central portion thereof. The horizontal lines of adhesive 30 will likewise increase the resistance to horizontal stretch as provided by the adhesive pattern, thereby providing additional control. It has been determined that the inclusion of the gap X at the central portion of the horizontal adhesive lines 30 prevents a bubbling of the fabric which, might otherwise occur if the stretch of the pattern is restrained across the entire span between corners 15-1 and 15-2, with respect to the remaining area of the diamond. The size of the diamond in FIG. 8 is also shown as somewhat larger than the diamond in the pattern of FIG. 4. Thus, with an existing geometric pattern of adhesive the degree of control can be adjusted by varying the size of the individual adhesive elements forming the pattern and/or supplemental adhesive elements placed within the main adhesive elements.

Figure 9:
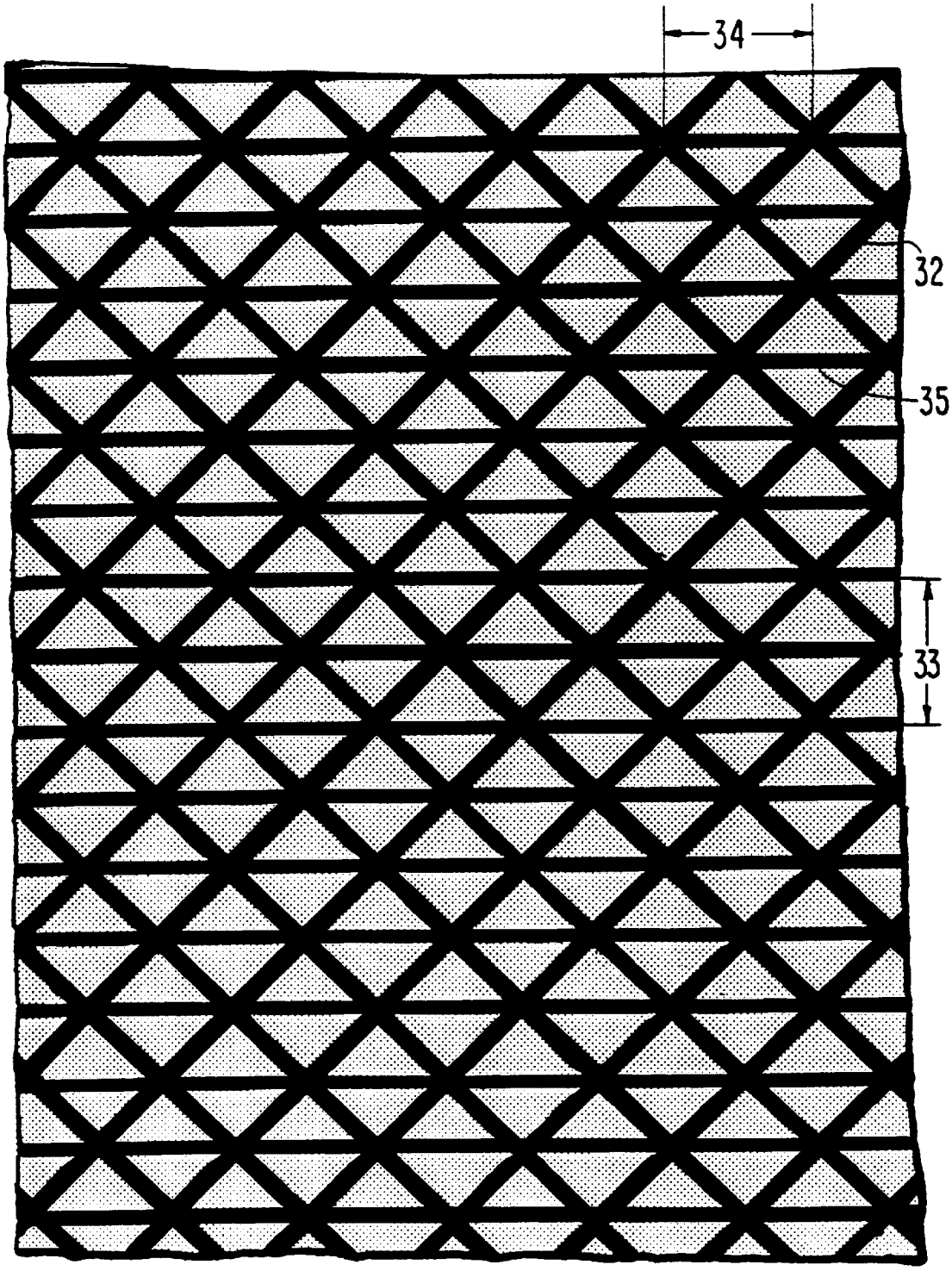

FIG. 9 shows still another pattern, wherein the shape of the diamonds 32 has been modified so that there is less of a variation between the vertical dimension 33 and horizontal dimension 34. However, the horizontal dimension is still less than the vertical dimension, such that the pattern shown in FIG. 9 will still be characterized as having a differential elongation which offers greater resistance to stretch in the horizontal direction than in the vertical direction. In addition, solid adhesive lines 35 extend across diametrically opposed horizontal corners of the diamonds 32. The tendency of this pattern to permit bubbling in the laminate panel would depend on several factors, including the stretch characteristics of the fabrics forming the laminate. Should bubbling occur, a gap may advantageously be included at the center of horizontal connecting bars 35, as typically shown by gap X of FIG. 8.

Figure 10:
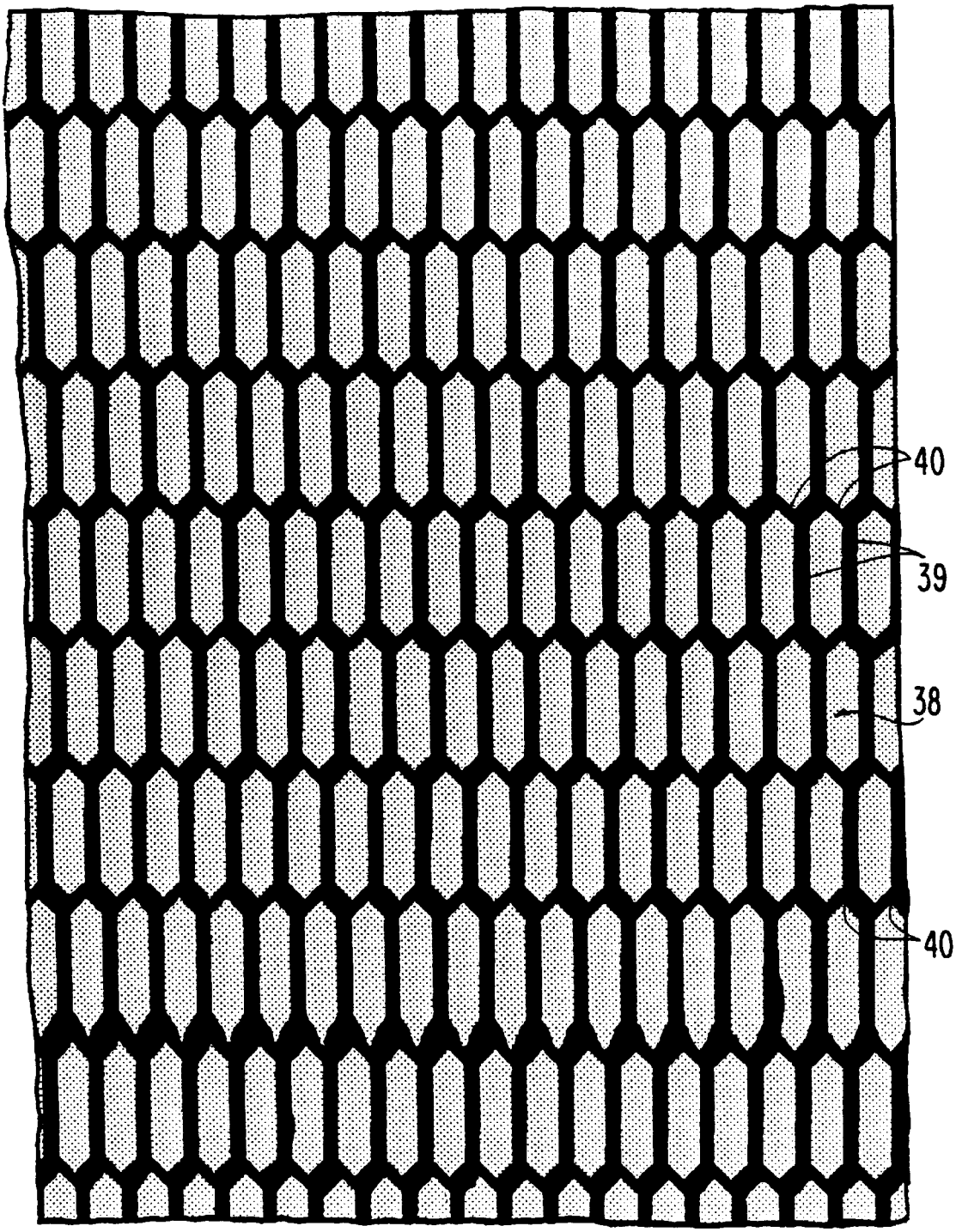

FIG. 10 is still another configuration of the adhesive securement layer. It is a regularly repeated pattern which, like the prior patterns, will be generally be coextensive with and uniformly presented over substantially the full extent of the reinforcement panel forming the fabric laminate. The array of aligned adhesive elements 38, rather than being diamond shaped, include elongated sides 39 between the upper and lower peaks 40 that would otherwise form the diamond. As in the prior patterns, the greater elongation of the individual elements 38 in the vertical direction would result in there being a differential elongation, with the pattern offering greater resistance to stretch in the horizontal than in the vertical direction. This pattern also advantageously includes discrete dots within each of the individual elements 38 in order to provide a smooth and secure laminate. If desired, horizontal bars of additional adhesive, as shown in FIG. 8 or 9, could be added.

Figure 11:
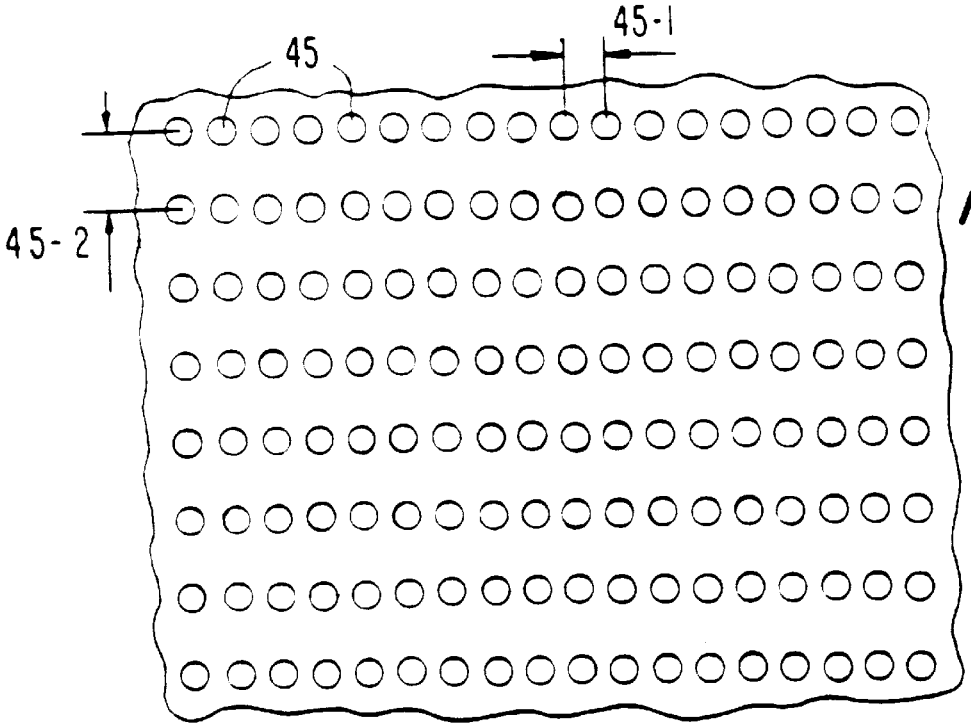

FIG. 11 shows still another arrangement of the individual elements forming the adhesive pattern. The individual elements are totally comprised of circular dots 45. They are arrayed such that the horizontal displacement 45-1 between adjacent circular members 45 is less than the vertical displacement 45-2. Thus, the successive generally horizontally and vertically extending rows are established with there being greater spacing between the horizontal rows than the vertical rows. Hence, the pattern will offer greater resistance to stretch in the horizontal direction. While not shown, if desired, additional smaller discrete dots of adhesive can be added throughout the pattern to insure a smooth laminate.

Figure 12:
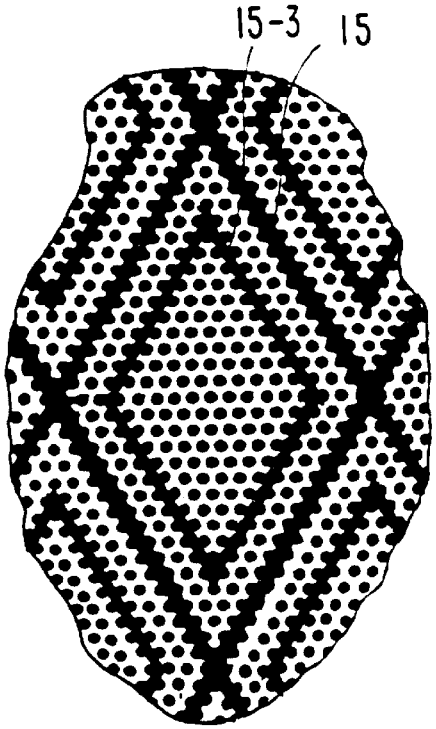

FIG. 12 shows still another variation of the pattern. For increased control, a second diamond adhesive element 15-3, is placed within each of the diamonds 15, of the pattern typically shown in FIG. 4 or 8.

It should however be understood that within the basic concept of the present invention numerous variations of patterns can be provided to both yield the desired degree of control in conjunction with the fabric of the reinforcement panel, as well as presenting a pleasant aesthetic effect, for enhancement of consumer acceptability.

FIG. 13 shows a panty 50, generally similar to the women's panty shown FIGS. 5 and 6 with the exception that instead of the stomach reinforcement being provided by a discrete laminate panel which is coextensive with the area of support and is separately sewn into the stomach portion of the garment (front panel 21 of FIG. 5), the reinforcement panel 59 at the stomach region is adhesively secured to the body fabric of a larger frontal panel 54. Hence, the additional control at the stomach portion is provided by stomach reinforcement panel 59 which is adhesively secured to the inside surface of only the central area of front panel 54. The panty 50 typically includes a waistband 52 and a main body fabric 54 which covers at least the full frontal portion of the garment. The fabric panel 54 may be sewn, as by stitches 56, to a rear panel 55. A crotch section 58 is provided at the lowermost portion of the garment. Binding 57 is sewn around the lower edges of front panel 54 and rear panel 55 to provide the garment with leg cut outs. Reinforcement panel 59 is typically constructed in the same manner as in the laminate shown in FIG. 1. Fabric 54 may correspond to fabric 11 and the reinforcement panel 59 fabric 12. Accordingly, reinforcement panel 59 will provide the requisite additional support and figure enhancing properties at the stomach region of the garment.

FIGS. 14–16 show the front, side and rear views of a modification of the panty shown in FIGS. 5 and 6. Specifically, the legs are lengthened and additional support panels are provided. Instead of having a separate rear fabric panel 25 (as shown in FIGS. 5 and 6) the side panels 22-1 are of a greater extent, meeting at the rear of the garment at vertical seam 29. Stomach panel 21-1 may generally correspond to stomach panel 21 shown in FIG. 5. Referring to FIG. 15, the side portion of each of panels 22-1 include a thigh control support panel 22-4 laminated thereto. The control panel 22-4 is formed in accordance with the present invention, utilizing the adhesive pattern with its primary elongation oriented in the vertical direction on a suitable inner support panel. The inner support panel forming laminate 22-4 may, if desired, be formed of the same fabric 12 which is used for the inner support panel of stomach panels 21 and 21-1.

FIG. 16 shows the additional placement of yet another support panel formed of the instant laminate. A rear control panel 22-3 is provided for a desired degree of derriere control. The adhesive layer in control panel 22-3 will be oriented with its primary elongation in the vertical direction. Thus, as in the stomach panel 21-1, the additional horizonal control is primarily in the horizontal direction. Alternatively, the rear seam 29 may be deleted by forming the side and rear paneling 22-1 and 22-2 in the general manner of the panty in FIG. 13, which includes a pair of side seams rather than a rear seam. If desired, the thigh control panel may be deleted in this embodiment. The teachings of the present invention may also be used for laminating a supportive control panel to other locations within a panty.

FIG. 17 shows the manner in which the present invention may be employed in conjunction with a pair of pantyhose 60. The pantyhose 60 comprises a panty portion 62, a pair of legs 64 integrally formed with the panty portion and depending therefrom, and a crotch piece 66. The yarn forming the panty portion 62 and leg sections 64 must have sufficient stretch properties in order that the garment may be expanded to closely confirm to the user's body shape. Preferably, the yarn may include an elastomer, such as Lycra, to enhance its body conforming abilities and provide a desired degree of figure control. For enhanced figure control an additional stomach support panel 66 is provided. Stomach panel 66 may be comprised of a non-elastomeric stretch fabric onto which a pattern of adhesive has been applied consistent with the teachings of the present invention. The selection of the fabric for the reinforcement panel, as well as the adhesive pattern may be suitably varied, from that employed for the panty of FIGS. 5–6, 13 or 14–16, in order to properly allow for the necessary initial stretch of the fabric forming the panty and leg sections 62 and 64, as well as the desired degree of body-conforming stretch and constraint. In particular, in order for the pantyhose to initially conform to the user's body, the fabrics utilized and the adhesive pattern applied to the reinforcement panel 66 will have to permit a greater degree of initial vertical stretch than would be required in the panties typically shown in FIGS. 5–6, 13 and 14.

Reference is now made to FIG. 18 which shows a brassiere 70 which utilizes the instant laminate as an undercup support. Brassiere 70 includes a pair of cups 72 which are inwardly connected by a central platform 73. The outer sides of the cups are connected to side panels 74 which are typically connected to each other by closure means 75 and 76, which are commonly referred to as a hook and eye, and shoulder straps 77. Cups 72 shown in this particular brassiere are formed of two fabric pieces 78 and 79 which are seamed together at 71. Alternatively, the cups could each be molded from a single piece of fabric, as is well known in the art. FIG. 19 shows lower section 78, which includes the instant laminate applied to its inside surface prior to assembly into brassiere 70. Lower cup section 78 includes the main fabric panel 83 to which the support panel 81 is laminated over at least a portion of its surface utilizing the adhesive securement layer of the present invention. In accordance with the present invention both fabrics 81 and 83 are stretch fabrics. However, main fabric panel 83 of the brassiere cup 72 would typically not include elastomeric yarn. Fabrics 81 and 83 are suitably oriented within the brassiere 70 , in conjunction with the orientation of the adhesive pattern used to secure the fabrics together, so that there is a sufficient restriction of the stretch of cup 72 along the portion of undercup section 78 which includes support panel 81. This is designed to provide the desired degree of underbust support. Advantageously, fabric 83 which forms the outer surface of cup section 78 is the same as the fabric which forms the upper cup section 79. For aesthetic purposes this may also be the same fabric used for side panels 74, except in those instances where it is desired that side panels 74 include an elastomeric yarn.

The teachings of the present invention may also be used for laminating a supportive control panel to other locations within a brassiere. Referring to FIGS. 20 and 21 there is shown approximately one half of a brassiere frame, i.e. a side panel 80 extending from the center portion 82 to the terminus 84 where a suitable hook and eye closure (not shown) may be placed. The side panel 80 has a breast cup portion generally shown as 86 which may include an undercup support panel (not shown) of the type discussed with reference to FIGS. 18 and 19. In the brassiere portion shown in FIG. 20, a side support panel 88 is laminated to the fabric of the side panel 80. It is located adjacent to the breast cup 86 and extends towards the terminus 84, with the configuration of control panel 88 providing the desired support along the wearer's side, adjacent to her cups. Specifically, the control area 88 flattens the sides of the bust to enhance the shaping, a feature desired in brassieres, while also reducing the stretch so as to provide control in the area adjacent to the cup of the brassiere.

FIG. 21 depicts the identical portion of the side panel 80. However, the control area provided by laminate panel 88-1 extends under the cup and to the central platform section between the cups.

It should be understood that appropriate fabrics are selected for the support panels shown in the brassiere of embodiments of FIGS. 18–21, which are coordinated with the fabrics of the brassiere, and are selectively oriented with respect to their elongation characteristics and the differential elongation characteristics of the pattern forming the adhesive securement, so as to combinedly provide the requisite control in the particular embodiment.

While it is naturally understood that various fabrics and adhesive patterns may be employed within the general teachings of the present invention, dependent upon the particular garment and the additional degree of control required, the following has been found to provide particularly good results for the panty shown in FIGS. 5 and 6, and utilizing the pattern of the adhesive securement layer of FIGS. 1–4. The main body fabric of the panty, (shown as 22 and 25 and FIG. 5 and corresponding with layer 11 shown in FIG. 2 of the laminated support panel), was a four bar Raschell-knit comprising 80% cotton 120/1 Nm, 17% Lycra, 140 denier and 3% nylon (with the nylon being provided for the aesthetics of a spaced dot configuration over the surface of the fabric). The elastomeric properties and modulas of this fabric were naturally obtained by the Lycra content. The fabric forming the reinforcement of stomach panel 21, (and fabric 12 of FIG. 1), was a non-elastomeric circular knit 85/1 Nm 100% cotton. The adhesive is a preferably a fast-drying adhesive, such as the 2P2 polyamide adhesive available from EMS Gmbh Domat-EMS, Switzerland.

FIG. 22 shows in a generalized form how the adhesive securement layer may be continuously applied as a regularly repeated pattern to fabric 12. The apparatus 100 shown therein includes a hollow cylinder 102 which is rotated about its axis 103. The outer surface of cylinder 102 is formed of a perforate screen in which the desired pattern of adhesive to be applied to fabric 12 is uniformly presented over the screen surface. A source of adhesive 104 has an outlet 106 for supplying the adhesive to the interior volume of cylinder 102, where it is uniformly distributed in the well-known manner. A doctor blade 108 extends throughout the length of cylinder 102. As the cylinder rotates, doctor blade 108 forces a desired amount of adhesive through the patterned opening of the screen forming the circumference of cylinder 102. This adhesive pattern is deposited on fabric 12, which is urged against the surface of cylinder in opposition to the doctor blade. Fabric 12, with the pattern of the adhesive deposited thereon is then transported to an oven (not shown) for the drying of the adhesive.

According to the present invention the elongation characteristics of a laminate, which is utilized to provide a reinforcement within an article of apparel, can be suitably modified by varying the pattern of adhesive. The adhesive securement will be in the form of a regularly repeated pattern generally coextensive with the area of the fabric forming the reinforcement panel, so as to maximize fabric yield. The adhesive pattern, in addition to providing the requisite physical properties may be visibly present at the outer surface of one of the fabrics. Hence, the pattern may be selected to provide a pleasing aesthetic presentation.

While specific embodiments have been disclosed, other modifications to the present invention will be obvious to those schooled in the art in the foregoing teachings. For example, the laminate may be incorporated in other garments such as men's undergarments, swimsuits, and other form-fitting stretch clothing utilized for skiing, bicycling or other athletic endeavors. Accordingly, while the present invention is disclosed with reference to specific embodiments and particulars thereof, it is not intended that these details be construed as limiting the scope of the invention, which is defined by the following claims:

We claim:

1. A fabric laminate comprising a first stretch fabric, a second stretch fabric and an intermediate adhesive securement layer;

said adhesive securement layer being positioned between opposed surfaces of said first and second stretch fabrics for adhesively securing said first and second stretch fabrics together along opposed surfaces thereof;

said adhesive securement layer being in the form of a regularly repeating definitive pattern generally coextensive with, and uniformly presented over, substantially the full extent of the fabric laminate;

said pattern comprising an array of aligned predeterminedly shaped adhesive elements repeatedly arranged in successive generally horizontally and vertically extending rows;

each of said vertically and horizontally extending rows characterized as having a surface area of adhesive formed by their adhesive elements, the surface area of said horizontally and vertically extending rows being of different magnitudes;

the array of said individual adhesive elements capable of offering resistance to elongation as the laminate is subjected to distortion, with said pattern having a differential elongation characterised as offering different magnitudes of resistance to elongation when the fabric laminate is subjected to distortion in selected different directions;

said adhesive securement layer being predeterminedly oriented in accordance with its differential elongation and the stretch characteristics of said first and second stretch fabrics, such that the resistance to elongation offered by the fabric laminate is determined by the pattern and orientation of the individual adhesive elements in conjunction with the stretch characteristics of said first and second stretch fabrics.

2. The fabric laminate of claim 1, wherein said first stretch fabric is an elastomeric fabric which includes an elastomeric yarn, said fabric having primary stretch in the generally horizontal direction and lesser stretch, or give, in the generally vertical direction, and the differential elongation provided by said pattern of adhesive elements which forms said intermediate securement layer offering greater resistance to stretch in one of its directions which is either the vertical or horizontal direction.

3. The fabric laminate of claim 2 wherein the differential elongation of said intermediate securement layer offers the greatest resistance to stretch in the generally horizontal direction.

4. The fabric laminate of claim 1 wherein the pattern of said adhesive securement layer comprises an array of successive diamond shaped adhesive elements, connected at their common sides to form generally horizontally and vertically extending rows of interconnected diamond shaped adhesive elements.

5. The fabric laminate of claim 4 wherein said diamonds are longer in a first direction than in a second direction, orthogonal to said first direction;

said diamonds being oriented such that said second direction corresponds to the maximum resistance of elongation provided by the differential elongation of said intermediate adhesive securement layer.

6. The fabric laminate of claim 5, wherein said second direction of said array of diamond shaped elements is generally horizontal.

7. The fabric laminate of claim 4, further including discrete dots of adhesive within each of said diamond shaped adhesive elements.

8. The fabric laminate of claim 7 wherein the distribution of said dots is predeterminedly selected to add a desired amount of resistance to elongation in addition to the resistance provided by said diamond shaped adhesive elements.

9. The fabric laminate of claim 4 wherein the width of the sides forming said diamond shaped adhesive elements is predeterminedly selected to provide a desired resistance to elongation.

10. The fabric laminate of claim 1 wherein the adhesive elements are further characterized as having a volume, including a thickness, and said thickness of the adhesive elements within said adhesive securement layer is predeterminedly selected to provide a desired resistance to elongation.

11. The fabric laminate of claim 4 wherein each of said diamond shaped elements is of essentially identical size over substantially the full extent of the fabric laminate.

12. The fabric laminate of claim 1, wherein said intermediate securement layer is of substantially uniform thickness over substantially the full extent of the fabric laminate.

13. The fabric laminate of claim 1, wherein said intermediate adhesive securement layer is formed of a heat sensitive adhesive.

14. The fabric laminate of claim 13, wherein said adhesive is a polyamide, applied to one of said stretch fabrics as a liquid.

15. The fabric laminate of claim 4, further including a bar of adhesive material extending between opposed corners of at least some of the diamonds.

16. The fabric laminate of claim 7, wherein the discrete dots of adhesive within the diamond are of non-uniform size, with the pattern of dots being substantially the same in each diamond.

17. An article of apparel having an additional support region over at least one portion thereof, said additional support region including a fabric laminate comprising a first stretch fabric, a second stretch fabric and an intermediate adhesive securement layer;

said adhesive securement layer being positioned between opposed surfaces of said first and second stretch fabrics for adhesively securing said first and second stretch fabrics together along opposed surfaces thereof;

said adhesive securement layer being in the form of a regularly repeating pattern coextensive with and uniformly presented over substantially the full extent of the fabric laminate;

said pattern comprising an array of aligned adhesive elements arranged in successive generally horizontally and vertically extending rows;

the array of said individual adhesive elements capable of offering resistance to elongation as the laminate is subjected to distortion, with said pattern having a differential elongation characterized as offering different magnitudes of resistance to elongation when the fabric laminate is subjected to distortion in selected different directions;

said adhesive securement layer being predeterminedly oriented in accordance with its differential elongation and the stretch characteristics of said first and second stretch fabrics, such that the resistance to elongation offered by the fabric laminate is determined by the pattern and orientation of the individual adhesive elements in conjunction with the stretch characteristics of said first and second stretch fabrics.

18. The article of apparel of claim 17, wherein said additional support region is provided at the region of the apparel overlying the wearer's stomach.

19. The article of apparel of claim 18 which is a panty or a pair of pantyhose.

20. The article of apparel of claim 17, wherein said article is a brassiere, and said additional support region is provided at the under area of each cup.

21. The article of apparel of claim 17, wherein said first stretch fabric is the main body fabric of a panty, said body fabric extends over substantially the entire area of at least the frontal portion of the panty;

said body fabric is an elastomeric fabric, having a higher degree of elongation in the horizontal direction than in the vertical direction, the differential elongation of said intermediate adhesive securement layer offering greater resistance to stretch in the horizontal direction than in the vertical direction; whereby said intermediate adhesive securement layer and second stretch fabric, secured to said main body fabric provides additional support at the portion of panty overlying the wearer's stomach.

22. A reinforcement panel for use in an article of apparel, the panel comprising a first stretch fabric, and an adhesive layer on a surface of said fabric for adhesively securing said first stretch fabric to a second stretch fabric;

said adhesive layer being in the form of a regularly repeating definitive pattern generally coextensive with and uniformly presented over substantially the full extent of the first stretch fabric;

said pattern comprising an array of aligned predeterminedly shaped adhesive elements repeatedly arranged in successive generally horizontally and vertically extending rows;

each of said vertically and horizontal extending rows characterized as having a surface area of adhesive formed by their adhesive elements, the surface area of said horizontally and vertically extending rows being of different magnitudes;

the array of said individual adhesive elements capable of offering resistance to elongation as the first stretch fabric is subjected to distortion, with said pattern having a differential elongation characterised as offering different magnitudes of resistance to elongation when the first stretch fabric is subjected to distortion in selected different directions.

23. Use of a reinforcement panel as claimed in claim 22 in the manufacture of a fabric laminate including a second stretch fabric secured to said first stretch fabric, which includes predeterminedly orienting the adhesive layer in accordance with its differential elongation and the stretch characteristics of said first and second stretch fabrics, such that the resistance to elongation offered by the fabric laminate is determined by the pattern and orientation of the individual adhesive elements in conjunction with the stretch characteristics of said first and second stretch fabrics.

* * * * *